United States Patent [19]

Bradshaw

[11] 4,103,778

[45] Aug. 1, 1978

[54] DISPLAY RACK

[76] Inventor: Gary W. Bradshaw, 1313 Rae St., Mt. Morris, Mich. 48451

[21] Appl. No.: 662,445

[22] Filed: Mar. 1, 1976

Related U.S. Application Data

[63] Continuation-in-part of Ser. No. 506,219, Sep. 16, 1974, abandoned.

[51] Int. Cl.[2] ..... A47F 7/16; A47F 7/19

[52] U.S. Cl. ..... 211/47; 211/102; 211/174; 211/208

[58] Field of Search ..... 211/44, 47, 48, 60 T, 211/66, 68, 57, 59, 98, 175, 190, 191, 193, 207, 208, 102, 103, 174

[56] References Cited

U.S. PATENT DOCUMENTS

| | | | |
|---|---|---|---|
| 339,081 | 3/1886 | Whitehurst | 211/44 |
| 341,806 | 5/1886 | Hitchcock et al. | 211/57 |
| 814,980 | 3/1906 | McCloskey et al. | 211/208 X |
| 1,061,001 | 5/1913 | Nelson | 211/47 |
| 1,763,318 | 6/1930 | O'Brien | 211/168 |
| 1,916,984 | 7/1933 | Naken | 211/60 T X |
| 2,786,579 | 3/1957 | Wright | 211/96 X |
| 2,987,195 | 6/1961 | Smith | 211/175 |
| 3,647,080 | 3/1972 | Denny | 211/191 |
| 3,939,985 | 2/1976 | Hochman | 211/57 |

FOREIGN PATENT DOCUMENTS

| | | | |
|---|---|---|---|
| 294,020 | 6/1968 | Australia | 211/191 |
| 519,439 | 2/1931 | Fed. Rep. of Germany | 211/96 |
| 723,029 | 2/1955 | United Kingdom | 211/47 |
| 215,652 | 5/1924 | United Kingdom | 211/96 |

*Primary Examiner*—Roy D. Frazier
*Assistant Examiner*—Thomas J. Holko
*Attorney, Agent, or Firm*—Arnold S. Weintraub

[57] ABSTRACT

A display rack for bolts of fabric and the like includes a plurality of freely rotatable display arms mounted on an elongated support member. In a prefered embodiment of the invention, two tiers of display arms are disposed.

4 Claims, 7 Drawing Figures

DISPLAY RACK

CROSS-REFERENCE TO RELATED APPLICATIONS

This application is a continuation-in-part application of copending U.S. patent application Ser. No. 506,219, filed Sept. 16, 1974 for "DISPLAY RACK" which application is now abandoned.

BACKGROUND OF THE INVENTION

1. Field of the Invention

The present invention relates to display devices. More particularly, the present invention pertains to display devices for garments, bolts of fabric and the like. Even more particularly, the present invention relates to display devices provided with a plurality of freely rotatable support arms upon which are mounted items to be displayed, such as, garments, fabrics and the like.

2. Prior Art

There has been disclosed heretofore a plurality of display devices for use in displaying garments, fabrics and other paraphenalia.

For example, German Pat. No. 519,439 teaches a display device wherein an L-shaped arm is inserted completely through a pair of spaced apart posts. Pairs of registering apertures are provided in the support posts which receive therethrough a leg of the L-shaped arms. The device shown by the German patent is U-shaped and is restrictive of motion of the L-shaped arms.

British Pat. No. 215,652 teaches a device for hanging trousers wherein a support member has its terminal end provided with a blind hole into which is inserted a supporting rod over which the trousers are draped. However, the structure accorded the display device is complex and not readily adaptable for use in public displays and the like, nor are the rods freely rotatable.

Another type of display device is disclosed in U.S. Pat. No. 1,240,611 wherein an L-shaped arm is inserted completely through pairs of registering apertures provided on legs of wall mounted brackets. This display device is utilized for displaying maps.

Other display devices of the type under consideration herein are shown in U.S. Pat. Nos. 992,105; 1,097,755 and 2,364,275.

However, with respect to the present invention the prior art fails to accommodate the present day needs of "self-serve" display devices wherein the goods displayed thereon must be readily visible, inspectable and removable therefrom.

As is known, in modern day shopping stores bolts of fabric and the like are ordinarily stacked on tables or other platforms in a vertical array. This mode of display inhibits the visibility, inspectability and removability of such goods, especially those not near or at the top of the stack. Moreover, by the close of a business day, the stacks are completely disturbed. Thus, man power is required, almost constantly, to re-arrange and rotate the stacks. Therefore, an extremely useful and efficacious device would be provided which is amenable to present day shopping modes and which overcomes the inconvenience pointed out herein.

SUMMARY OF THE INVENTION

The present invention provides a free standing display device for garments, bolts of fabric and the like. The device hereof includes an elongated support means comprising two vertically spaced apart support members. The uppermost support member is provided with a throughbore which is in registry with a partial bore provided in the lower member of the support means.

An L-shaped display rod or arm has one leg thereof insertable into the registering apertures and the other leg thereof extending in a horizontal axis away therefrom. The other leg has a garment, bolt of fabric or the like draped thereover.

By the structure accorded the present invention, the rods or arms are freely rotatable in a horizontal plane.

In an alternate embodiment of the invention the spaced apart vertical supports include inwardly projecting, opposed, vertically-extending members. The members, each, have a plurality of apertures provided along the extent, thereof. The support means include apertures at the ends thereof which register with the apertures of the members associated with the vertical supports. Fastening means interconnect the support means to the members. In this manner the support means thereof is rendered vertically adjustable.

In a preferred embodiment of the present invention two tiers of support means are deployed, each having a plurality of registering bores or apertures formed therein. Thus, a plurality of display arms are also included in the preferred embodiment thereof.

For a more complete understanding of the present invention reference is made to the following detailed description and accompanying drawing. In the drawing like reference characters refer to like parts throughout the several views in which:

DESCRIPTION OF THE PREFERRED EMBODIMENT

Figure 1:
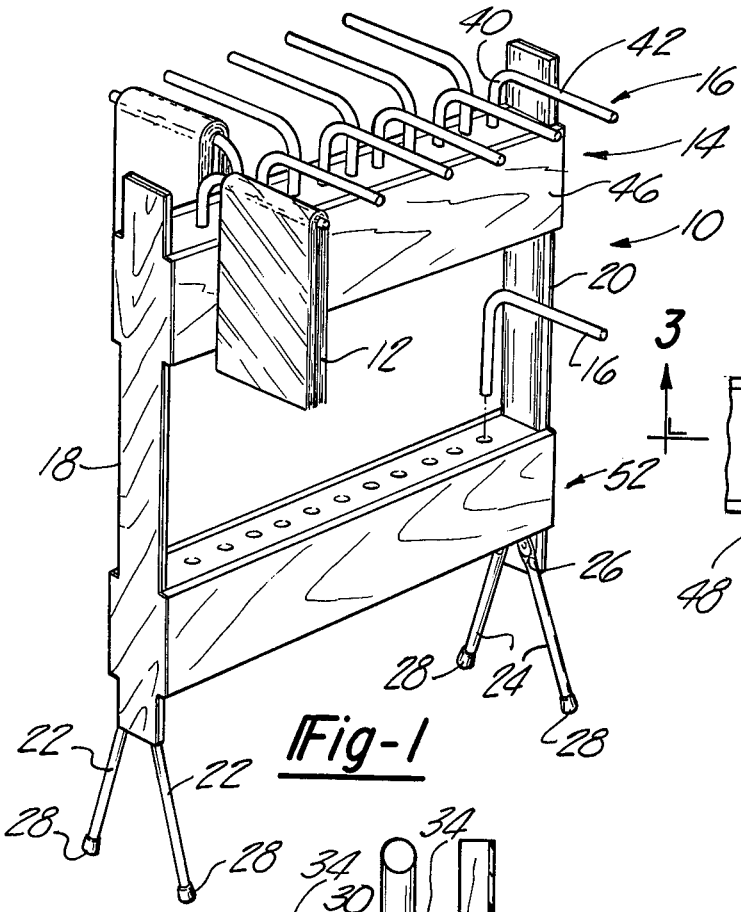
FIG. 1 is a perspective view of the display device of the present invention.

Now with reference to the drawing, in particular FIG. 1, there is depicted, in accordance with the present invention, a free standing display device, generally indicated at 10, particularly adapted for displaying bolts of fabric 12, garments and the like. The display device 10 generally includes elongated support means 14 which supports a freely rotatable display rod or arm 16 over which the fabric bolt 12 or the like is draped.

With more specificity and with reference to FIGS. 1-4, the display device 10 hereof comprises a pair of upstanding elongated support posts 18, 20. As will subsequently be described, the support posts 18, 20 provide lateral support to the elongated support means 14.

A pair of legs 22, 24 is disposed at the lower end of each of the support posts, 18, 20 respectively. Each leg of each pair is secured at one end thereof, to its respective post by any suitable fastening means, such as a nut and bolt combination 26. As shown in the drawing each leg of each pair is inclined with respect to the other leg of such pair at an acute angle to provide stability to the display device. Optionally, cap members 28 are placed over the free ends of the legs to protect the ground surface upon which the device 10 is placed, in a manner well known.

The support means 14 extends between and abuts against the support posts 18, 20 and is secured thereto by any suitable means (not shown) such as by gluing, threaded fasteners, nails and the like.

Figure 2:
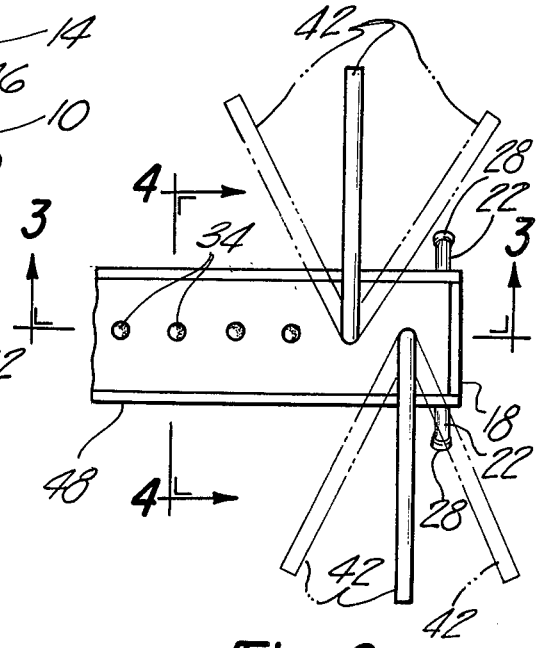
FIG. 2 is a broken top plan view, partly in phantom, of the display device of the present invention.
Figure 3:
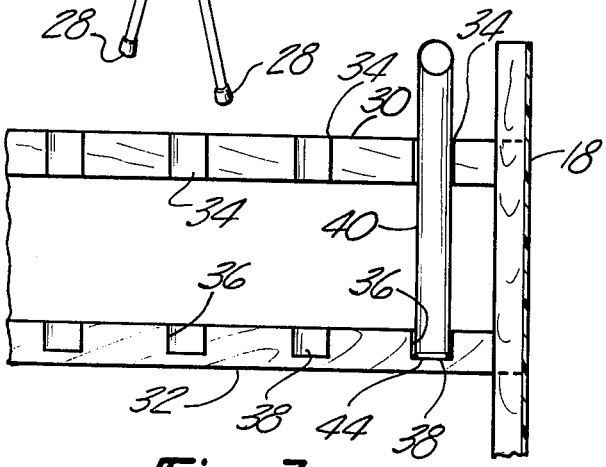
FIG. 3 is a cross-sectional view taken along the line 3—3 of FIG. 2.
Figure 4:
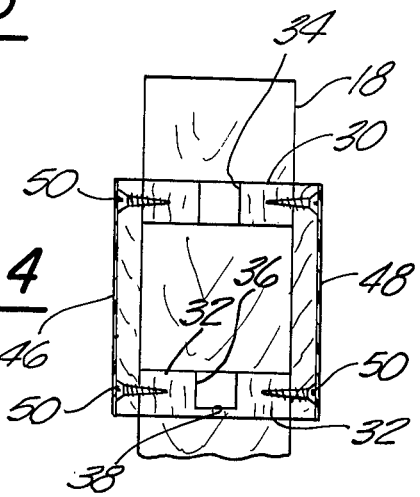
FIG. 4 is a cross-sectional view taken along the line 4—4 of FIG. 2.

As clearly shown in FIGS. 2–4, the support means 14 comprises a pair of vertically spaced apart first and second members 30, 32 respectively. The support members 30, 32 are coextensive and are substantially parallel to each other. The first or uppermost member 30 is provided with at least one aperture or throughbore 34. Preferably, a plurality of such throughbores 34 are provided along the extent of the member 30 and are, optimally, equidistantly spaced apart.

The second or lower member 32 is provided with at least one bore or aperture 36. The bore 36 is only a partial bore, such that its terminus defines a seat 38. Preferably, and as shown, a plurality of partial bores are provided along the extent of the lower member 32. In accordance with the present invention, each, respective, throughbores 34 and partial bores 36 are in registry and co-axially aligned.

The present invention, as noted, further includes at least one freely rotatable display rod or arm 16. The display rod or arm 16 is, preferably, L-shaped and comprises first and second legs 40 and 42, respectively, either of which is insertable into an associated throughbore 34 and partial bore 36 to securely mount the arm 16 onto the support means 14. As clearly shown in FIG. 3, preferably, the lower member 32 is vertically placed from the upper member 30 a predetermined distance such that the end 44 of the inserted leg 40 of the rod 16 abuts against the seat 38 defined by the terminus of the partial bore 36.

In accordance with the present invention, and as defined by the natural orientation of the device 10, the free or other leg 42 of the rod 16 extends in a horizontal plane. Because of the dimensioning of the bores 34, 36, diameter-wise, the rod 16 is stable and non-rotatable in a vertical plane. However, the rod 16 is freely rotatable in the horizontal plane alluded to hereinbefore and is, thus, variably positionable. This feature enables goods, such as, the bolt 12 to be readily inspected by a potential purchaser thereof.

As shown in the drawing, preferably, there is a display rod associated with each pair of throughbore and registering partial bore. Moreover, the display rods are preferably formed from a strong, rigid materials to support the weight of the goods placed thereon. Thus, materials such as steel, reinforced plastics and the like can be utilized in ofrming the rods 16.

In order not to detract from the visibility of goods and to reinforce the stability of the support means 14, side or lateral panels 46, 48 are provided. The lateral panels 46, 48 extend beyond the length of the support means 14 to completely enclose same laterally. The panels are secured to the side edges of the upstanding posts at the ends thereof by any suitable means, such as threaded fasteners 50. The lateral panels are vertically dimensioned to be coincident with the vertical distance between the top surface of the upper member 30 and the bottom surface of the lower member 32. In this manner the lateral panels completely laterally enclose the support means 14.

In practicing the present invention, and as shown in FIG. 1, the display rods 16 are inserted into the support means 14 in an array such that some of the legs 42 extend in a first horizontal direction. The remainder of the legs 42 extend in the opposite horizontal direction. To maximize useage of the device 10, the direction of the legs 42 in which they extend is staggered, as shown.

Furthermore, and in a preferred embodiment of the present invention, the instant display device 10 comprises a two-tiered structure. The two-tiered structure comprises two support means 14, 52, analogously constructed. The support means 14, 52 are vertically spaced apart a distance sufficient to accommodate a lower level of display rods 16 associated with the lower support means 52.

The second support means 52, as noted, is constructed and deployed in a manner identical to that described with reference to support means 14.

Figure 5:
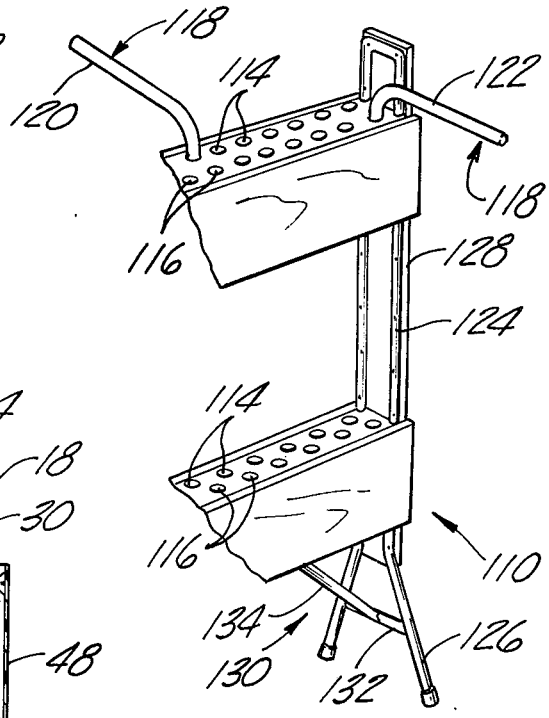
FIG. 5 is a partial perspective view of an alternate embodiment of the present invention.

With reference to FIG. 5, there is depicted therein an alternate embodiment of the present invention, generally indicated at 110. In this embodiment, the support means 112 is constructed as hereinbefore described. However, the support means 112 thereof is provided with a plurality of throughbores 114, 116, respectively. The bores 114 and 116 are provided on either side of the central axis of the support means 112, as shown, such that the bores 114 define a first row thereof and the bores 116 define a second row thereof, along the extent of the support means 112.

Each bore 114 and 116 is in registry with a partial bore (not shown) provided in the lower surface (not shown) of the support means.

In this embodiment of the invention, a display rod 118 is associated with each bore 114 or 116 and its associated partial bore (only two rods being shown). It is to be appreciated that the free legs 120 of the display rods 118 associated with the row defined by the bores 114 extend in a first horizontal direction, when normally positioned. Concommitantly, the free legs 122 of the display rods 118 associated with the row defined by the bores 116 extend a second horizontal direction, when normally positioned. The second direction is opposite to the first direction.

The present embodiment further includes a pair of spaced apart upstanding support posts 124, (only one being shown) of simpler construction than heretofore described. In accordance herewith, the support posts 124 comprises an integral upward extension of the pairs of legs 126 respectively. Thus, the upstanding posts 124 are, each, unitarily constructed with their, respective, pairs of legs 126. In essence, there is provided an inverted elongated U-shaped member having the ends of the legs thereof flared outwardly.

Each upstanding post has an exterior enclosure 128 secured thereto in any suitable manner, such as by bolts or the like.

To increase the stability of this embodiment of the invention, each pair of legs 126 includes a support brace 130. Each brace comprises a cross strut 132 secured to its respective pair of legs 126 at each end thereof by any suitable means, as shown. A centrally disposed stabilizer 134 is integrally formed with or otherwise secured to its associated cross strut. The stabilizers extend angularly upwardly from their, respective, cross struts. The free ends of the stabilizers are secured to the under surface of the lower member of the lower support means, as shown. Thus, the support braces, as is apparent, increase the free standing stability of the device 110.

Figure 6:
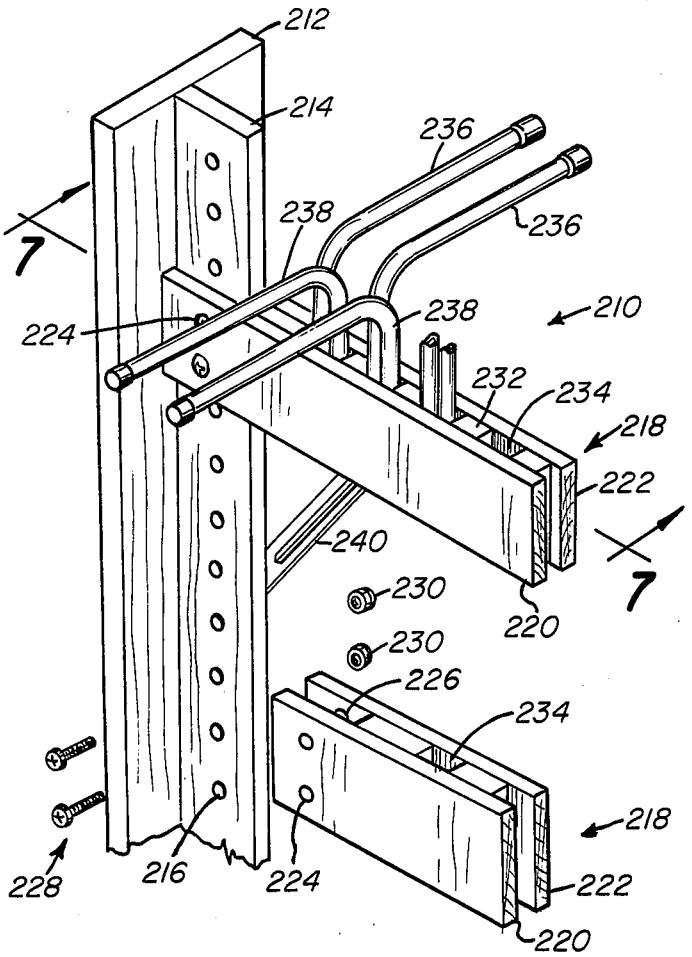
FIG. 6 is a partially broken, exploded, perspective view of a further embodiment of the invention.
Figure 7:
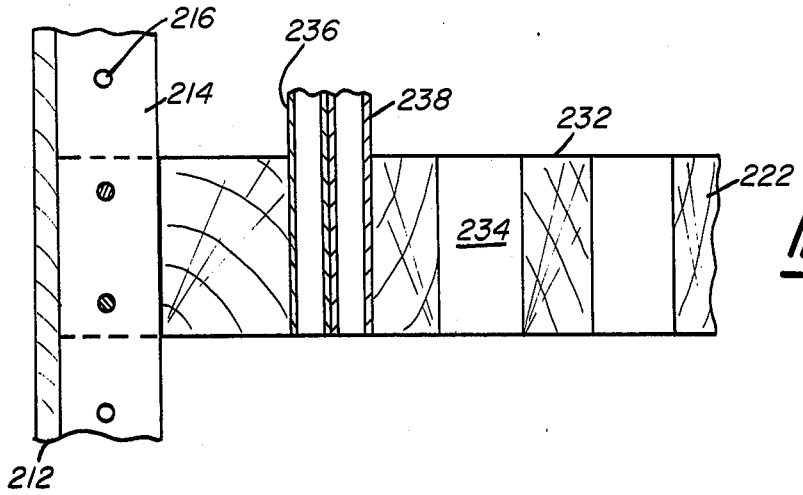
FIG. 7 is a cross-sectional view taken along the line 7—7 of FIG. 6

Referring now to FIGS. 6 and 7 there is depicted a further embodiment of the invention and, generally, denoted at 210. According to this embodiment of the invention, there is provided a pair of spaced apart vertically upstanding ground engaging support posts 212, only one of which is shown. An inwardly projecting member or support brace 214 is integrally formed with or otherwise connected to each of the posts 212. The member 214 extends substantially along the length of the support post 212. In essence the member 214 and the post 212 cooperate to define a T-shaped support. As shown in the drawing, the member 214 is disposed centrally of the post 212. The other member on the opposite post is opposed to the depicted post and analogously constructed thereto. A plurality of apertures 216 are provided through the member 214 along the extent thereof. The apertures are substantially equidistantly spaced and lie along a common axis. As will subsequently be shown, the apertures cooperate with fastening means to render the support means positionally adjustable.

The support means of this embodiment is, generally, denoted at 218. The support means 218 comprises a pair of spaced apart outer bodies 220, 222. The outer bodies are parallel to each other and coextensive. The bodies 220, 222 are spaced apart a predetermined distance such that their respective, opposed inner surfaces abut against the, respective, opposed outer surfaces of the member 214. Proximate each end of each body there is formed at least one aperture 224, 226. The aperture provided in one body is in registry with the aperture provided in the other body, to define or provide pairs of registering apertures. The apertures are formed in the bodies such that when the ends of the bodies abut against the inner surface of the post 212, the apertures 224, 226 lie along the common axis of the apertures 216. Thus, the support means 218 can be positionally adjusted or disposed along the extent of the support post 212. After the desired position is attained, the support means is secured in position via fastening means 228. Suitable fastening means, such as screws, can be disposed through a pair of registering apertures 224, 216 and a selected aperture 216 along the brace 214. A nut or bolt 230 can then be threadably connected to the free end of the screw in the known manner.

The support means 218 further comprises a plurality of spacers 232. The spacers are disposed between the bodies 220, 222 along the extent thereof. The spacers 232 have a height substantially equal to that of the bodies 220, 222. The spacers 232 are disposed along the extent of the space between the bodies in a predetermined array, such as to define gaps 234 therebetween. The gaps 234 are substantially equal in width and are dimensioned to accomodate pairs of garment display rods 236, 238 therewithin.

The display rods 236 or 238 comprise substantially L-shaped members having first and second legs, one of the legs is frictionally retained in an associated gap 234. The other or free leg extends substantially perpendicular to the bodies. In accordance with the present invention, pairs of display rods 236, 238 are disposed in each gap and frictionally retained therewithin. Furthermore, the free leg of one rod extends in a first horizontal direction while the free leg of the other rod extends in a second, opposite horizontal direction, as shown.

Thus, it is to be appreciated that the gaps 234 are dimensioned to frictionally retain pairs of display rods therewithin. Thus, the depth of the gap is substantially equal to or slightly less then the diameter of the leg of the display rod associated therewith.

This embodiment of the present invention, also, contemplates support bars 240 which extend between the support means 218 and the brace 214. The support bars interconnect the support means 218 to the brace by any suitable mode, and preferably have one end secured to one of the bodies. The other end has an obtuse bend and is insertable into any one of the apparatus 216.

In practicing this embodiment of the invention it is preferred that there be employed a pair of spaced apart support means 218.

It is to be further noted that any suitable materials of construction, such as, wood, plastic, aluminum, and the like can be efficaciously deployed in constructing the instant device.

It is apparent from the preceding that there has been described herein a display device which is eminently useful in advantageously displaying and merchandising domestic goods in modern day stores.

Having, thus, described the invention, what is claimed is:

1. a free standing display device, comprising:

(a) a pair of spaced apart upstanding support posts, (b) an inwardly directed support brace connected to each support post, each brace extending along the length of the associated post, each brace having a plurality of throughbores along the extent thereof, (c) at least one support member extending between the support posts, the support member being vertically positionally adjustable between the support posts, the support member comprising:

(1) a pair of spaced apart bodies, the inner surfaces of the ends thereof abutting against the opposed lateral sides of the braces, (2) a plurality of spacers equidistantly spaced apart and disposed between the spaced apart bodies, the spacers defining a plurality of adjacent gaps along the extent of the support means, (3) the ends of each body having at least one aperture, the apertures of one end being in registry and alignable with any one of the throughbores of the brace associated therewith, (d) a plurality of display rods frictionally retained by the support member in the gaps, and (e) means for connecting the ends of the support member to the support braces, the connecting means comprising fastening means, the fastening means being insertable through the registering apertures and associated throughbores, and wherein the fastening means, registering apertures and throughbores cooperate to render the support means vertically positionally adjustable.

2. The display device of claim 1 wherein:

a pair of display rods are disposed within each gap.

3. The display device of claim 2 wherein:

each display rod comprises an L-shaped member having a first leg disposed in the gap and a second leg extending in a horizontal direction substantially perpendicular to the support member, and wherein the second leg of one of the pairs of display rods extends on a first horizontal direction and the second leg of the other display rod of the pair extends in an opposite horizontal direction.

4. The display device of claim 1 which further comprises:

a pair of vertically spaced apart support members.

* * * * *